US010863602B2

(12) United States Patent
Holtman

(10) Patent No.: US 10,863,602 B2
(45) Date of Patent: Dec. 8, 2020

(54) METHODS AND APPARATUS FOR DETECTING CONNECTION OR DISCONNECTION OF AN AUXILIARY LOAD TO A DRIVER

(71) Applicant: SIGNIFY HOLDING B.V., Eindhoven (NL)

(72) Inventor: Koen Johanna Guillaume Holtman, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/637,934

(22) PCT Filed: Aug. 9, 2018

(86) PCT No.: PCT/EP2018/071610

§ 371 (c)(1),
(2) Date: Feb. 10, 2020

(87) PCT Pub. No.: WO2019/030318

PCT Pub. Date: Feb. 14, 2019

(65) Prior Publication Data

US 2020/0178374 A1 Jun. 4, 2020

(30) Foreign Application Priority Data

Aug. 11, 2017 (EP) ..... 17185989

(51) Int. Cl.
*H05B 47/10* (2020.01)

(52) U.S. Cl.
CPC ..... *H05B 47/10* (2020.01)

(58) Field of Classification Search
CPC ..... H05B 45/00; H05B 45/10; H05B 45/30; H05B 47/00; H05B 47/10; H05B 47/14; H05B 47/185; H05B 47/21; H05B 47/22
See application file for complete search history.

(56) References Cited

U.S. PATENT DOCUMENTS

| | | | | |
|---|---|---|---|---|
| 2007/0155349 | A1 | 7/2007 | Nelson et al. | |
| 2009/0058321 | A1 | 3/2009 | Furuse | |
| 2011/0015795 | A1 | 1/2011 | Boyer et al. | |
| 2014/0159864 | A1 | 6/2014 | Allen et al. | |
| 2016/0255684 | A1* | 9/2016 | Dai et al. | H05B 47/10 |
| 2017/0171950 | A1 | 6/2017 | Barna et al. | |
| 2019/0393826 | A1* | 12/2019 | Lai | H02S 40/32 |

FOREIGN PATENT DOCUMENTS

| | | | |
|---|---|---|---|
| EP | 3001778 | A1 | 3/2016 |
| WO | 2006126172 | A2 | 11/2006 |
| WO | 2014000765 | A1 | 1/2014 |
| WO | 201736826 | A1 | 3/2017 |

OTHER PUBLICATIONS

Goltermann: "Elektronisch Stabillisierte Netzeinheit", Operator's Manual, Reutlingen, Germany, Feb. 28, 1962, pp. 1-19.

* cited by examiner

*Primary Examiner* — Jimmy T Vu

(57) ABSTRACT

There is provided a driver having a primary output, for a primary load, and an auxiliary output, for an auxiliary load. A power supply of the driver supplies power to both outputs. Connection or disconnection of an auxiliary load is determined by detecting a change in power consumption at the auxiliary output, and an action is performed by a driver controller in response to this change in power consumption.

14 Claims, 4 Drawing Sheets

METHODS AND APPARATUS FOR DETECTING CONNECTION OR DISCONNECTION OF AN AUXILIARY LOAD TO A DRIVER

CROSS-REFERENCE TO PRIOR APPLICATIONS

This application is the U.S. National Phase application under 35 U.S.C. § 371 of International Application No. PCT/EP2018/071610, filed on Aug. 9, 2018, which claims the benefit of European Patent Application No. 17185989.5, filed on Aug. 11, 2017. These applications are hereby incorporated by reference herein.

FIELD OF THE INVENTION

This invention relates to the field of drivers, and in particular, to drivers adapted to provide power to both a primary output and an auxiliary output.

BACKGROUND OF THE INVENTION

It is well known to provide a driver which connects a mains power supply to a load, where the driver is able to regulate or otherwise control the power provided to the load. Drivers of this sort are particularly common in lighting or sound installations.

Drivers which are capable of providing power to a plurality of loads are becoming increasingly popular. These drivers are typically designed to provide power to a primary load, and are typically further adapted to connect to one or more auxiliary loads. The connected one or more auxiliary loads may also draw power from the driver. Thus, a driver may comprise at least a first interface or output for connecting to a primary load and a second interface or output for connecting to an auxiliary load. See e.g. EP3001778A1.

Due at least to this increasingly popular trend in driver capable of providing power to a plurality of loads, there is a desire in the market for improving the functioning and application of such drivers.

SUMMARY OF THE INVENTION

The invention is defined by the claims.

There is proposed a driver comprising a primary power output adapted to electrically connect to a primary load of the driver; an auxiliary power output adapted to electrically connect to an auxiliary load of the driver; a power supply for providing power to the primary power output and the auxiliary power output; and a driver controller adapted to: determine whether there is a change in a power consumption at the auxiliary power output caused by an auxiliary load connecting to or disconnecting from the auxiliary power output; and in response to determining that said change in power consumption has occurred, perform at least one action in respect of the auxiliary load and/or the primary load.

The present invention thereby provides a driver in which an action is triggered in response to a detected change in power consumption at an auxiliary output. The change in power consumption is indicative of a connection or disconnection of an auxiliary load to the driver.

An action performed by the driver, triggered by the change in power consumption, may include any one or more of: an auxiliary load monitoring step; an auxiliary load identification step; a restriction of a power supply to the auxiliary load and so on.

In one particular embodiment, the action may comprise cutting the auxiliary power output to an auxiliary load that is connected, but is unidentifiable. By cutting the power, we can ensure that an unknown, and possibly hostile and/or unauthorized, auxiliary load will not receive the power necessary to execute an attack against the system of which the driver is part, or an attack against other systems or people in close proximity.

The present invention recognizes that plugging an auxiliary load into or unplugging an auxiliary load from a driver causes a change in power consumption at the auxiliary output of that driver. In particular, the invention recognizes that this change in power consumption may be used to trigger an action of the driver with respect to the auxiliary load. As used herein, any actions taken by the driver as a result of the change in power consumption (caused by the auxiliary load) are performed in relation to the auxiliary load. Said change may particularly be an instantaneous change.

The change for connecting an auxiliary load could, for example, be a jump from no power being consumed (e.g. 0 mW, open circuit) to a minimum amount (e.g. 10-100 mW) of power being consumed at the auxiliary output by the plugged-in auxiliary load. By way of example, this jump may be an instantaneous or substantially instantaneous change in the power consumption, as mentioned, caused by an auxiliary load connecting or disconnecting to the auxiliary power output. For example, said change may be a power consumption dip or peak, or may be a power consumption increment.

Moreover, said change for connecting an auxiliary load may be a permanent or a temporary jump in power consumption, such as respectively a step with respect to a reference output power of the driver; or a peak/dip.

Hence, as mentioned, the present invention provides a driver in which an action is triggered in response to a detected instantaneous change in power consumption at an auxiliary output itself, which instantaneous change causes a detectible gradient in power consumption being characteristic for the connected or disconnected auxiliary load.

This allows a simple and accurate determination of when a load has been connected or disconnected to a driver, without the need for external components (e.g. a photodetector) or other complex monitoring techniques (e.g. output interface interrogation methods). The proposed concept also ensures that connection/disconnection of an auxiliary load causes a corresponding reaction of the driver. The proposed techniques allow actions to be performed by a driver, for example, even if an auxiliary load has no communication capabilities, or is unable to transmit communications to the driver (e.g. due to incompatibility, outdated software, expired license, or lack of transmitter).

An auxiliary load may be used to provide additional capabilities to the primary load. For example, an auxiliary load may provide sensing, communication or memory capabilities to a system of which the driver is a part. In some examples, an auxiliary load may sense parameters of a primary load and may act as a meter. Thus, an auxiliary load that is optionally added to a driver having a connected primary load may allow a primary load to be more compact, as desirable, but potentially optional, capabilities of the primary load may be outsourced to the auxiliary load which can be connected on an as-needed basis.

Embodiments of the invention are particularly advantageous when employed in a lighting system or installation. Thus said driver may be a lighting driver. In particular, it has been recognized that lighting systems have a particular need for a primary and auxiliary load, for at least the reason of restricted space/weight requirements in typically light installation locations, such as retro-fit locations. In envisaged lighting systems, the primary load is a light source (e.g. comprising an LED, an LED string or a halogen bulb), and in some cases some sensing and communication hardware, and the auxiliary load provides additional monitoring/control/communication for that light source or for the driver.

The auxiliary load may also provide sensing/control/communication features that are not related to an illumination function of the primary load. Particular embodiments envisage that lighting systems can act as convenient hosting platforms for sensors and communication devices that fulfill other needs of the people or devices in the vicinity of the driver, such as a need to monitor the air quality in a building.

Embodiments enable a high degree of configurability for a system comprising the driver, as auxiliary loads may be connected and disconnected from the driver to thereby provide modularity. Performing actions in response to a connection or disconnection enables a driver to respond accordingly to a new configuration of the system.

Preferably, the maximum power provided to the primary output is greater than a maximum power provided to the auxiliary output. Thus, the primary load may be able to draw more power from the driver than the auxiliary load. This advantageously ensures that a primary intended operation of the driver can be maintained when auxiliary loads are connected thereto. This may also ensure that an auxiliary load does not divert power required by a (usually more important) primary load.

In examples, the maximum power provided to the primary output may be at least ten times greater than a maximum power provided to the auxiliary output; such an embodiment is advantageous, as the drawn power by a load at the auxiliary output (e.g. a sensor) is significantly smaller than the power provided to the primary load (e.g. a light source).

Preferably, the primary load is a light source. For example, the primary load may be a light generating load such as a LED string. As previously explained, embodiments are particularly advantageous when employed in a lighting installation.

The driver optionally further comprises a power limiting unit adapted to controllably cut off or limit the power provided to an auxiliary load connected to the auxiliary power output. In this way, one of the actions performed by the driver controller may be to cut off or limit power provided to an auxiliary load. This allows for the power consumption of the auxiliary load to be controlled, and may allow for unauthorized or unpermitted loads to be disconnected from the driver so as to not draw power therefrom.

The at least one action performed by the driver controller may comprise determining an availability of an identifying signal for the auxiliary load. An identifying signal is considered to be available if the driver is able (at some point) to obtain the identifying signal for the auxiliary load.

The availability and/or non-availability of an identifying signal may influence further actions performed by the driver controller, and thereby increases a configurability and modularity of the driver. Moreover, an embodiment may comprise only checking for an identifying signal when a connection/disconnection has occurred, to thereby reduce a power consumption of the driver.

The at least one action performed by the driver controller may comprise sending a request for the identifying signal to the auxiliary load. Thus, the driver controller may actively perform a check for an identifying signal. Performing such a request may increase the security of the identifying signal and any actions performed in response.

Preferably the identifying signal comprises digitally readable identifying information for the auxiliary load, and the driver further comprises a permission checker adapted to, in response to determining that the identifying signal is available, process the digitally readable identifying information for the auxiliary load to determine at least one permission of the auxiliary load.

By way of example, the identifying signal may comprise digitally readable identifying information for the auxiliary load, and the driver further comprises a permission checker adapted to, in response to the availability of the identifying signal containing digitally readable identifying information, process this digitally readable information for the auxiliary load to determine at least one permission of the auxiliary load with respect to the driver.

In one embodiment, the permission checker is adapted to use cryptographic means to verify whether the digitally readable identifying information comprises license data which has been generated by a trusted license granting authority so as to determine at least one permission of the auxiliary load.

That is, the permission checker may determine whether the digitally readable identifying information comprises license data which has been generated by a trusted license granting authority so as to determine the at least one permission of the auxiliary load.

In some examples, the identifying information comprises the precise identity of the auxiliary load, such as the manufacturing serial number. In other or further embodiments, the identifying information may comprise a classification identity of the auxiliary load, for example, identifying that the auxiliary load is a member of a certain class of loads. By way of another example, the identifying information may identify whether the auxiliary load is a trusted or licensed device. The identifying information may contain license data.

The auxiliary load may thereby be validated using digitally readable identifying information (e.g. information about a license) of the auxiliary load, and permissions determined therefrom.

In one embodiment, the at least one permission of the auxiliary load comprises a permission to draw power from the driver, and the driver controller is adapted to either cutting off or limiting the power provided to an auxiliary load connected to the auxiliary power output if the auxiliary load is not associated with a permission to draw power from the driver.

Methods comprise securely controlling how an auxiliary load can receive power or otherwise interact with the driver, the primary load and/or an overall system comprising the driver. This may be instrumental in prohibiting unauthorized devices (e.g. unlicensed devices) from interacting with the system, driver and/or primary load, and thereby provides a layer of security and/or configurability. For example, methods may limit the ability of an unauthorized device to use power from the driver in order to attack the security or privacy of other systems or people in the vicinity of the driver.

Different auxiliary loads may have different permissions with respect to the driver. The different permissions may, for example, depend upon a level of a license associated with an auxiliary load.

By way of further example, the at least one action performed by the driver controller may comprise any one or more of: limiting a maximum power drawn by a connected auxiliary load; determining an identity of a connected or disconnected auxiliary load; determining a classification type of a connected or disconnected auxiliary load; generating an output signal indicating whether an auxiliary load has been connected to or disconnected from the auxiliary power output; comparing a power drain of the primary load and a power drain of the auxiliary load; beginning or ending a timer; beginning or ending a monetary transaction; performing an authorization check for the auxiliary load; performing an authorization check for the auxiliary load and sending an alert signal if the check does not detect that the auxiliary load is authorized; and performing an authorization check for the auxiliary load and sending an alert signal if the check does not detect that the auxiliary load is authorized, wherein the alert signal controls an operation of the primary load so to indicate an alert (e.g. in case the primary load is a light source, said alert signal may be controlling the light source to blink red).

Thus, the driver controller may perform any number of actions in response to a connection/disconnection of an auxiliary load to the driver, as indicated by the change in power consumption at an auxiliary output. Preferably, the actions are performed with respect to the auxiliary load, which advantageously ensures that the driver controller appropriately responds to a connection/disconnection of the auxiliary load.

In examples, the at least one action may be performed in respect of the primary load. Hence, by way of further example, in response to determining that said change in power consumption at the auxiliary power output has occurred, the at least one action performed by the driver controller may comprise any one or more of: cut off or limit the power provided to the primary load; setting the primary load to a stand-by (or sleep) state, wherein for example the primary load may enter a stand-by state upon determining an unauthorized auxiliary load and/or may be re-activated (out of the stand-by state) upon determining an authorized auxiliary load; determining the operating parameters of the primary load at the time of connecting or disconnecting the auxiliary load; providing control commands to the primary load, such as for example change intensity or modus; in case the primary load drives a light source, said at least one action may comprise changing color, intensity, color temperature, modulation and/or lighting scene associated with said light source; triggering a pre-defined control algorithm in the driver controller, such as e.g. a time-out sequence or commissioning process; start a commissioning process, modifying the content of a pre-existing control command program stored in the driver controller; provide as mentioned an alert signal or a confirmation by means of controlling the primary load (e.g. a visual or audio output); or any combination thereof. Such examples are advantageous, because the primary load may be controlled based upon determining said change in power consumption at the auxiliary power output has occurred. Particularly, starting a commissioning process is advantageous: when the primary load is a light source, the driver controller of the driver driving the light source may determine a connection of a sensor device, e.g. a light sensor (e.g. authorized and having correct qualifications for commissioning), and in response to said determining perform an action of commissioning and/or calibration (the action being e.g. emitting a color, varying intensity, or performing visible light communication). Another example, particularly, cutting off of limiting power provided to the primary load may be advantageous whenever an unauthorized or unqualified auxiliary load is determined to be connected to protect the operations of the primary load, and vice versa when disconnecting.

The identifying signal may be in accordance with one of: a near-field communication protocol; a Bluetooth protocol; a Digital Addressable Lighting Interface (DALI) protocol; a Universal Asynchronous Receiver/Transmitter protocol (UART); a USB protocol; an $I^2C$ protocol; and a Power over Ethernet (PoE) protocol.

Thus, the identifying signal may be provided to the driver using any suitable wired or wireless communication protocol. It would be particularly advantageous, for the sake of security and improved reliability, to use a wired communication protocol, where the identifying signal is provided to the driver controller via the wires running through the connector for the auxiliary power output. This would also reduce an amount of wiring and/or components (e.g. Bluetooth or NFC receivers) required to pass the identifying signal to the driver controller.

The driver may be adapted to receive the identifying signal via a communication channel between the driver and the auxiliary load. In particular, the auxiliary load may be adapted to route messages, such as the identifying signal, between an independent device (which may generate the identifying signal) and the driver.

In one such embodiment, the driver may comprise a pair of wires which run to the auxiliary output, which use a DALI bus protocol that combines the power delivery and bidirectional communication facilities over just this pair of wires. In another embodiment, there may be four wires running through the connector for the auxiliary power output, two wires being power and ground wires, and the other two wires being used for bidirectional communication, using an electrical protocol such as UART, USB, or $I^2C$.

Preferably, the driver is a driver for a lighting installation, i.e. a lighting driver; and the primary power output is adapted to connect to a light source of the lighting installation. In particular embodiments, the auxiliary power output is adapted to connect to an auxiliary load which provides sensing, control, communication or monitoring capabilities for the lighting installation.

There may be provided a lighting installation comprising a driver previously described, wherein the primary power output is adapted to connect to a light source of the lighting installation; and the auxiliary power output is adapted to connect to an auxiliary load which provides sensing, control, communication or monitoring capabilities for the lighting installation (or an area in the vicinity of the lighting installation).

There is also proposed a control method of a driver having a primary power output adapted to electrically connect to a primary load of the driver; an auxiliary power output adapted to electrically connect to an auxiliary load of the driver; and a power supply for providing power to the primary power output and the auxiliary power output, the method comprising: determining whether there is a change in a power consumption at the auxiliary power output caused by an auxiliary load connecting or disconnecting to the auxiliary power output; and in response to determining that said change in power consumption has occurred, performing at least one action in respect of the auxiliary load and/or the primary load.

The least one action may comprise any of those previously described.

The control method may further comprise controllably limiting the power provided to an auxiliary load connected to the auxiliary power output of the driver based on the determined at least one permission of the auxiliary load.

The control method may further comprise controllably limiting the power provided to the primary load connected to the primary power output of the driver based on the determined at least one permission of the auxiliary load.

There is also proposed a computer program comprising computer program code means which is adapted, when said computer program is run on a computer, to perform the method previously described.

BRIEF DESCRIPTION OF THE DRAWINGS

Examples of the invention will now be described in detail with reference to the accompanying drawings, in which.

DETAILED DESCRIPTION OF THE EMBODIMENTS

According to a concept of the invention, there is proposed a driver having a primary output, for a primary load, and an auxiliary output, for an auxiliary load. A power supply of the driver supplies power to both outputs. Connection or disconnection of an auxiliary load is determined by detecting a change in power consumption at the auxiliary output, and an action is performed by a driver controller in response to this change in power consumption.

Embodiments are at least partly based on the realization that a connection or disconnection of an auxiliary load to a driver may cause a change in power consumption at an auxiliary output of that driver. The driver may react to this change to perform an action to thereby respond to a newly connected or disconnected auxiliary load.

Illustrative embodiments may, for example, be employed in lighting installations, where a driver provides and controls a voltage supply of a light source. It is particularly advantageous to enable connection of auxiliary loads to a driver for a light source, as the driver and/or light source may be restricted in size, component budget, and/or weight. Thus, connecting an auxiliary load provides a light source with the ability to perform additional actions (e.g. communication, sensing or monitoring) with greater configurability and modularity, without adversely affecting the size, component budget, and/or weight of a light source or associated driver.

As used herein, the term "primary load" refers to a primary load or main load driven by the driver, being the load for which the driver is designed to provide an output power supply. For example, a primary load of a lighting installation would typically be a light source. The term "auxiliary load" is used to refer to any other, supplementary or optional loads which may draw power from the driver, such as a secondary load. For a lighting installation, the auxiliary load may include any one or more of: ambient light sensors, temperature sensors, electricity meters, sensors not related to the lighting function but satisfying other needs of people or other devices in the vicinity of the lighting system, and so on.

Figure 1:
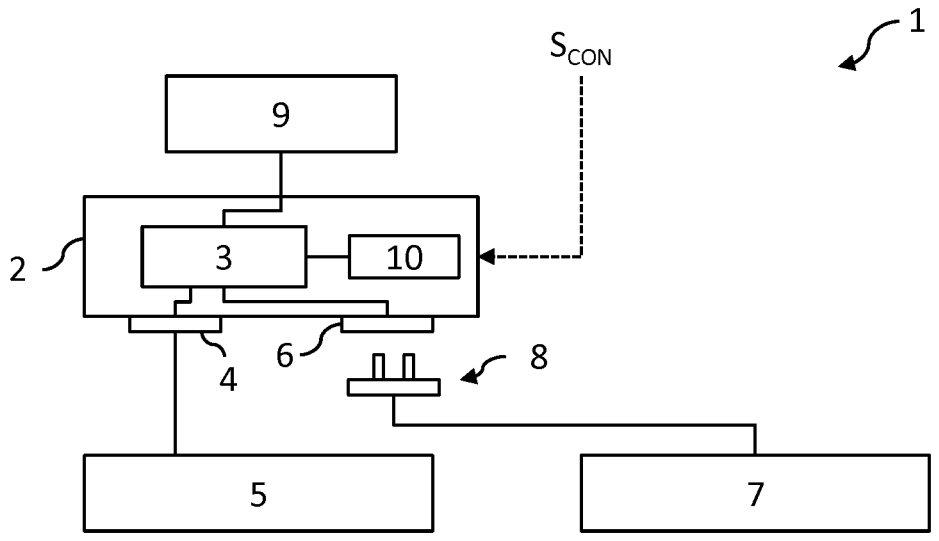
FIGS. 1 and 2 show a driver according to an embodiment of the invention.
Figure 2:
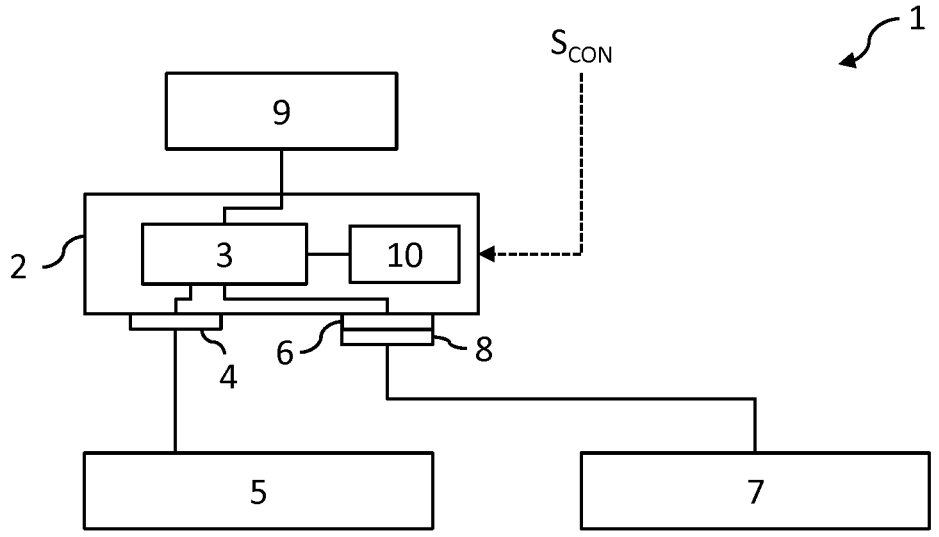

FIGS. 1 and 2 both illustrate a driver 2, according to an embodiment of the invention, in the context of a lighting installation 1. The driver 2 comprises a power supply 3.

A primary power output 4 or primary power interface is electrically connected to the power supply 3, and is electrically connectable to a primary load 5 or primary device. The primary load 5 draws power from the power supply 3 via the primary power output. In some embodiments, the primary power output is fixedly or permanently connected to the primary load. The primary load 5 may comprise a light source, such as an LED string, that is mounted on the same circuit board substrate as the electrical components of the driver 2 itself.

An auxiliary power output 6 or auxiliary power interface is also electrically connected to the power supply 3, and electrically connectable to an auxiliary load 7 or auxiliary device. In particular, the auxiliary load 7 is connectable to the auxiliary power output 6 so as to draw power from the power supply 3. Preferably, the auxiliary power output is selectably connectable to the auxiliary load 7 (i.e. the auxiliary power output is designed to allow the auxiliary load to connect and disconnect therefrom).

The power supply 3 optionally comprises dedicated power supply components (e.g. a transformer, a buck converter, or a current limiter to protect against output short-circuits) adapted to deliver power to the auxiliary power output. Thus, the power provided to the auxiliary power output may be different from the power provided to the primary power output, for example it can have a different voltage.

The power supply 3 may, for example, contain two different transformers, one for each output 4, 6. Preferably, each output 4, 6 shares at least one technical component with the other output 4, 6, for example, they both draw power from a same mains input connector or battery.

The primary power output 4 is an interface for electrically connecting to a primary load of the driver. The auxiliary power output 6 is an interface for electrically connecting to an auxiliary load of the driver.

FIG. 1 illustrates the lighting installation 1 when the auxiliary load 7 is electrically disconnected from the driver 2. FIG. 2 illustrates the lighting installation 1 when the auxiliary load 7 is electrically connected to the driver, so as to draw power from the power supply 3.

The auxiliary load may connect, for example, to the auxiliary power output 6 using a plug fitting 8. The plug fitting 8 may consist of any known electrical connector, and may be in any known form, for example, comprising one or more pins for connecting to the auxiliary power output 6 to draw power therefrom, and optionally additional pins for e.g. monitoring signals or exchanging data. Consequently, the auxiliary power output 6 may comprise a complimentary interface (e.g. a socket) for receiving the plug fitting 8 from the auxiliary load 7.

The power supply 3 may comprise any known power conversion apparatus for converting electrical power from a first form to a second form, where the second form is suitable for driving at least the primary load. For example, the power supply 3 may convert a mains supply 9 to a supply for driving a connected primary load 5 and a supply for driving a connected auxiliary load. Suitable power converters are well known in the art and may comprise, for example, one or more of: a switched-mode power supply; a transformer; a rectifier; a filter; a filament emulation unit and so on.

The driver 2 further comprises a driver controller 10 adapted to control an operation of the driver. For example, the driver controller 10 may be adapted to control a voltage and/or current level provided by the power supply to a primary/auxiliary output; control whether power is provided to the primary power output and/or the auxiliary power output and so on.

In an embodiment, the driver controller 10 is adapted to receive a control signal $S_{CON}$ which is used to control an operation of the driver. In particular examples, the control signal $S_{CON}$ indicates a desired voltage level of the power provided by the power supply 3 to the primary output 4, and may thereby indicate a desired operation of the primary load 5. For example, if the primary load 5 comprises a light source, the control signal $S_{CON}$ may represent a desired dimming level; or if the primary load comprises a speaker, the control signal $S_{CON}$ may represent a desired volume level.

The present invention relates to a method of detecting a point or time at which the auxiliary load 7 is connected or disconnected to the auxiliary power output 6 and performing an action in response thereto.

To do so, the driver controller 10 is adapted to detect a change in power consumption at the auxiliary output. In response to detecting a change in power consumption, the driver controller 10 determines that an auxiliary load has connected to or disconnected from the driver 2 and performs an action. For example, a (sudden or instantaneous) increase in power consumption at the auxiliary output may be indicative that an auxiliary load has connected to the driver (and drawing power therefrom) whereas a (sudden or instantaneous) decrease in power consumption at the auxiliary output may be indicative that an auxiliary load has disconnected from the driver (and thereby no longer drawing power therefrom).

A wide variety of possible actions are envisaged, and may include: identifying the auxiliary load; authenticating the auxiliary load; shutting off power to the auxiliary load if the auxiliary load cannot be identified as a trusted system component, limiting power to the auxiliary load if an a valid license asserting the right of the auxiliary load to consume a certain level of power is not is not available in the identifying signal; adjusting a voltage level of a supply at the auxiliary output; generating an output signal indicating an auxiliary load has been connected; controlling a maximum power drain by the primary load and/or the auxiliary load; registering each connection/disconnection of the auxiliary load in a memory; and so on.

Figure 3:
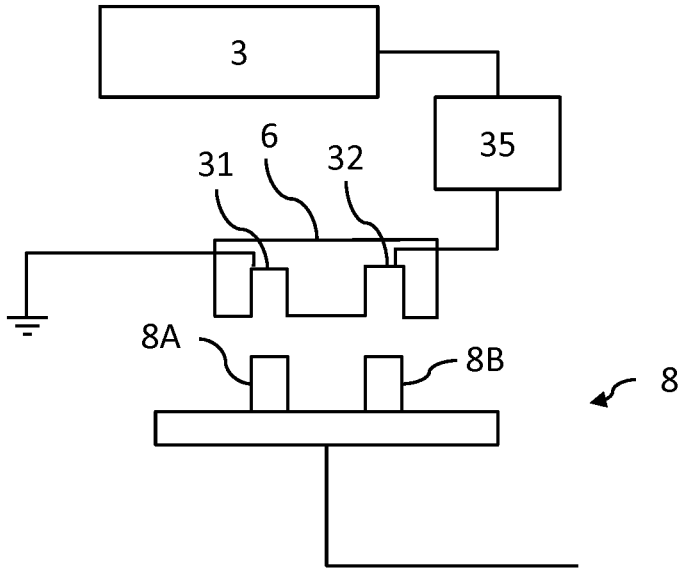
FIG. 3 is a diagram illustrating a method of detecting a change in power consumption at the auxiliary output according to an embodiment.

There are numerous envisaged methods of monitoring a power consumption or detecting a change in the power consumption at the auxiliary load. One example is illustrated in FIG. 3, which shows the auxiliary output 6 prior to a connection of a plug fitting 8 of an auxiliary load 7. Alternatively, detecting a change in power consumption at the auxiliary load may be done by monitoring the power provided by the driver to the primary load.

Here, the plug fitting 8 comprises a first pin 8A and a second pin 8B. The auxiliary output 6 comprises a first pin socket 31 and second pin socket 32 for receiving the first 8A and second 8B pins respectively. When the plug fitting is connected to the auxiliary output, current can flow between the first socket 31 and the second socket 32 (i.e. via the auxiliary load). Thus, the presence or absence of a current flow between pin sockets of an auxiliary output may be indicative of a connection or disconnection of an auxiliary load to the auxiliary output. Put another way, a change in current flow in an auxiliary output indicates a change in power consumption at the auxiliary output.

Thus, to detect a change in the power consumption caused by a connecting or disconnecting of the auxiliary load (via the plug fitting) the driver controller may comprise a current sensing device 35. The current sensing device 35 (e.g. an ammeter) is adapted to detect a current flow therethrough, and may be connected to detect a current flow through or to the auxiliary output. The current sensing device 35 may be serially connected to the auxiliary output, for example, between the power supply 3 and the auxiliary output 6.

Preferably, the current sensing device 35 provides a binary signal indicating whether a current is detected (i.e. an auxiliary load is connected) or a current is not connected (i.e. no auxiliary load is connected).

In at least one embodiment, the current sensing device provides a binary signal indicating whether a detected current is above or below a predetermined current value (being a value greater than 0 mA). This may allow the current sensing device to take a possible trickle or leakage current (e.g. caused by a capacitive coupling of a supply to the primary output) into account when determining whether an auxiliary load has been connected. A detected current above the predetermined current value indicates an auxiliary load is connected to the auxiliary output and a detected current below the predetermined current value indicates that no auxiliary load is connected to the auxiliary output. The predetermined current value may be in the region of 0.01 mA to 1 mA, for example, around 0.1 mA.

In an embodiment, the current sensing device is adapted to provide a signal only when a tracked or monitored current crosses the predetermined current value. This may provide an explicit indication of a connection and/or disconnection of an auxiliary load to the auxiliary output (e.g. at an instantaneous point in time). For example, if a current crosses the predetermined current value (from high to low) this may indicate that the auxiliary load has been disconnected from the auxiliary output.

The measured current may, for example, be a RMS current value (e.g. for the case of an AC current supply for the auxiliary load) or an actual value (e.g. for the case of a DC current supply to the auxiliary load).

Figure 4:
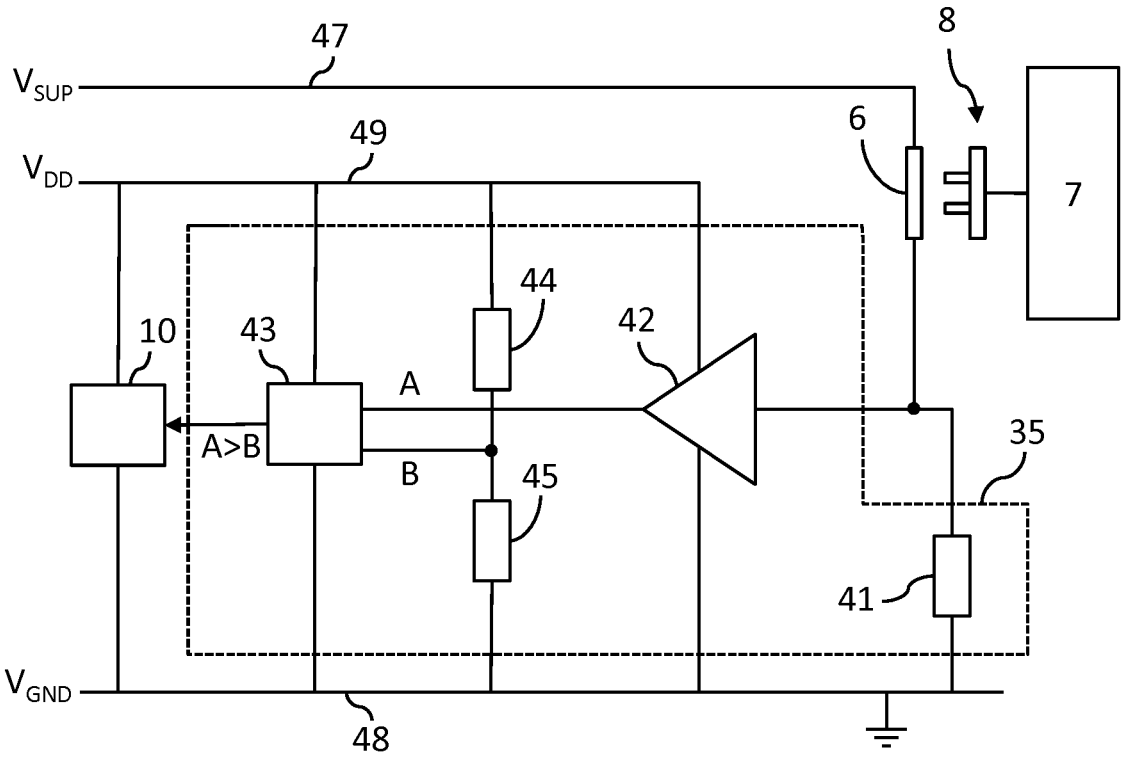
FIG. 4 shows a circuit diagram of device for detecting a change in power consumption due to plugging or unplugging of an auxiliary load.

FIG. 4 illustrates an embodiment of a current sensing device 35 in more detail.

The auxiliary output plug 6 delivers a power supply $V_{SUP}$ to the auxiliary load 7, using a power rail 47 and ground rail 48 in a known manner. The voltage of the power supply $V_{SUP}$ may be in the region of 24V.

The presence of a power-consuming auxiliary load 7 causes a voltage differential over a sensing resistor 41, connected between the plug 6 and the ground rail 48, as current can flow through the plug 6. This differential is amplified by an amplifier 42, the amplified voltage being fed to a first input of a comparator 43. This comparator 43 compares the amplified voltage A to a reference voltage B received at a second input of the comparator 43. The comparator has an output 'A>B', which provides a binary signal indicative of whether the amplified voltage A is greater than (e.g. '1') or less than or equal to (e.g. '0') the reference voltage B. The comparator may be arranged according to any known method, for example, using an operational amplifier configuration. The output binary signal A>B may be fed to a digital input pin of a microcontroller 10.

The binary signal A>B output by the comparator 43 indicates whether a current flows through the auxiliary output 6, and whether this current is above a predetermined current value.

The predetermined current value can be modified by selecting appropriate values for the sensing resistor 41 and the bias resistors 44, 45. Changing the value of the sensing resistor 41 alters the amplified voltage A for a same current. Changing the value of the bias resistors alters the reference voltage B. The selection of resistor values should also take into account the amplification factor or gain of the amplifier 42.

To power the components of the current sensing device 35, a low-power rail 49 may also be provided by the power supply. The reference voltage B is created using bias resistors 44 and 45 arranged between the low-power rail 49 and the ground rail 48 in a voltage divider configuration. Alternatively, the bias resistors 44, 45 may be arranged between the power rail 47 and the ground rail 48. The low-power rail may carry a voltage supply in the region of 3.3V. In some embodiments, the low-power rail 49 is powered by a transformer coupled to the power rail 47.

In response to detecting a change in power consumption at the auxiliary output, as indicated by the binary signal switching from low to high or vice versa, the driver 2 determines that an auxiliary load has been connected or disconnected to the driver 2.

Thus, the proposed concept does not require a driver to comprise a dedicated external element for actively monitoring for connection/disconnection of an auxiliary load (e.g. a light-sensitive element). Rather, detection of a change in power consumption provides a simple, reliable and power-efficient way to detect connection of an auxiliary load.

As briefly identified above, the driver controller 10 performs at least one action in response to detecting a change in power consumption at the auxiliary output indicative of a connection and/or disconnection of an auxiliary load. Thus, the driver controller 10 responds to a connection of an auxiliary load.

Figure 5:
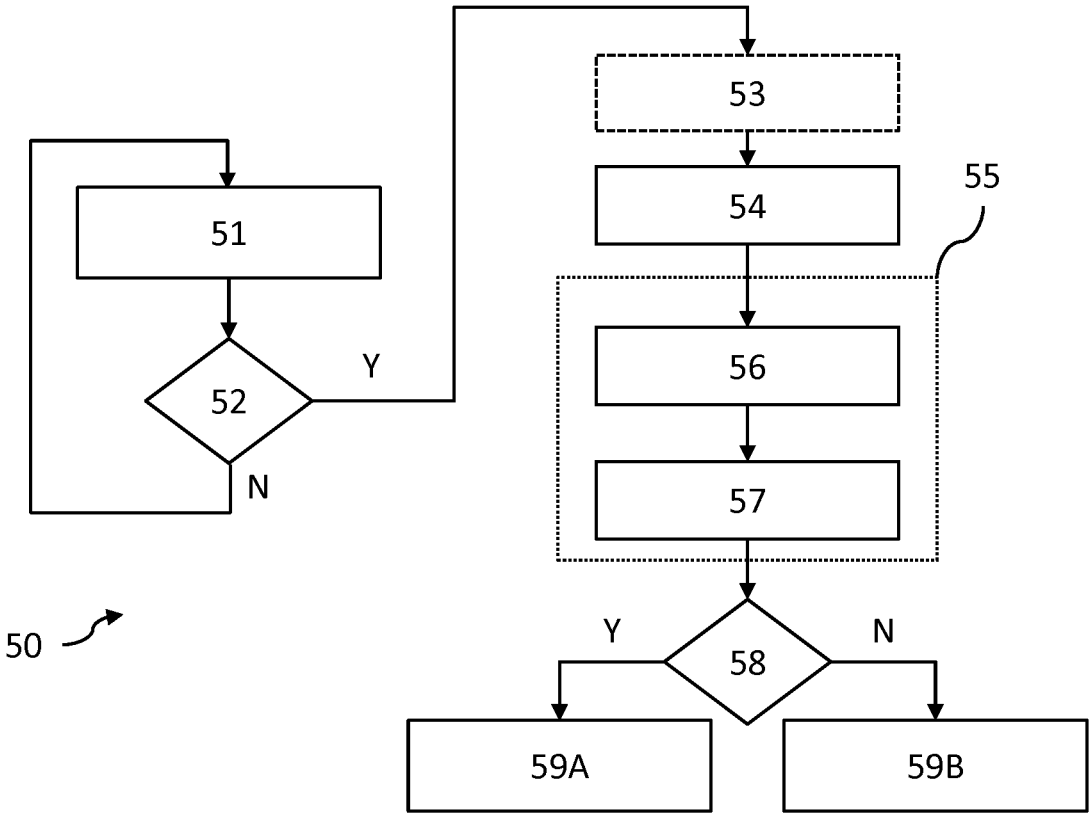
FIG. 5 illustrates a method according to an embodiment.

FIG. 5 illustrates a method 50 carried out by a driver controller 10 according to an embodiment.

The method 50 comprises a step of monitoring 51 the power consumption at the auxiliary output. In step 52, it is determined whether a change in power consumption has occurred. In response to determining that a change in power consumption has occurred indicating the attachment or detachment of a new auxiliary load, the driver controller performs an action.

Here, the action comprises a step 53 of requesting an identifying signal for the auxiliary load 7 and a step 54 of receiving an identifying signal for the auxiliary load (if available).

The identifying signal preferably carries digitally readable identifying information for the auxiliary load. This digitally readable identifying information typically comprises information about a license, a classification or an identity of or associated with the auxiliary load. The digitally readable identifying information may be used to identify one or more permissions of the auxiliary load, as later explained.

The step 53 may be understood to comprise determining whether an identifying signal for the auxiliary load is available (i.e. whether the driver is able to obtain an identifying signal). This may, for example, include receiving an indication that an identifying signal will be sent or receipt of the identifying signal itself.

The step 53 of requesting an identifying signal is optional, and the method 50 may instead comprise, for example, waiting a predetermined length of time to receive the identifying signal, or waiting for the auxiliary load to start a sequence of interactions that will (presumably) lead to the receipt of an identifying signal, such as the auxiliary load beginning to draw power in a predetermined manner. Thus, the receiving of an identifying signal may be performed passively, and a communication between the driver controller and the device supplying the identifying signal may be bidirectional or unidirectional (e.g. from the auxiliary load only).

However, requesting the identifying signal may improve a security of connecting the auxiliary load to the driver. For example, the request may be encoded, the encoded request being decodable only by an authorized auxiliary load, an auxiliary load running a correct program or an auxiliary load capable of communicating with an approved license granting authority (such as a cloud computing server). In another example, the request may form part of a handshake protocol to ensure the auxiliary load complies with a suitable communication protocol for the driver.

In an example, a request may contain a nonce to be processed by an authorized license granting authority. Thus, the auxiliary load (or other device providing the identifying signal) may need to pass the nonce to an authorized server for appropriate processing and authorization, the processed nonce being returned to the driver controller 10 as the identifying information. This decreases a likelihood of a device being able to spoof or otherwise act as an authorized device.

The identifying signal may be obtained directly from the auxiliary load 7 (e.g. using a UART rx/tx line or other communication channel). That is, the auxiliary load 7 may be adapted to provide the identifying signal to the driver controller 10.

In some examples, the auxiliary power output 6 is adapted to allow communication between the auxiliary load 7 and the driver controller 10. For example, the auxiliary power output may comprise elements in compliance with a USB (universal serial bus) protocol, a UART (Universal Asynchronous Receiver/Transmitter) protocol or a DALI (Digital Addressable Lighting Interface) protocol.

In other embodiments, the auxiliary load is adapted to communicate with the driver controller using a wireless communication method, such as Bluetooth and/or Near-Field Communication techniques. The driver may thereby comprise a wireless transmitter and/or receiver adapted to wirelessly communicate with at least the auxiliary load. Other suitable wired or wireless protocols for enabling communication between the auxiliary load 7 and the driver controller 10 will be well-known to the skilled person.

There may be a predetermined time delay (not shown) between the step 52 of determining a change in power consumption and the steps 53, 54 of requesting and receiving the identifying signal. This may advantageously allow the auxiliary load 7 to perform a required start-up sequence before the driver controller expects the identifying signal to be provided. The predetermined time delay may be in the region of 0.1 to 600 seconds, for example, around 60 seconds. This has advantageously been recognized as being sufficiently long to allow a start-up procedure of the auxiliary load to be performed, whilst reducing a potential power drain by that auxiliary load and decreasing the likelihood of an auxiliary load performing a malicious process before an action is performed by the driver controller.

The method 50 may further comprise a process 55 of determining at least one permission for the auxiliary load 7, with respect to the driver 2, primary load 5 and/or other elements of a system containing the driver 2, based on the identifying signal, and in particular on digitally readable identifying information carried by the identifying signal. Thus, the process 55 may comprise processing digitally readable identifying information to determine at least one permission.

If no identifying signal and/or no identifying information is provided in steps 53/54, then the process 55 determines that no permissions are to be associated with or otherwise granted to the auxiliary load.

The process 55 may comprise a step 56 of using cryptographic means to determine whether the identifying information contains license data issued by a trusted license granting authority. The license data may, for example, consist of an information block or packet of the identifying information or an encryption method of the identifying information. To verify that the information block has not been tampered with, and that is has been created by a trusted license granting authority, the process 55 may comprise cryptographically checking the integrity of the block and/or the validity of a signature on the block. This may be performed using public key information for a server which has previously been stored in a memory of the driver, e.g. at the manufacturing time of the driver, and optionally via communication with an external server (such as the license granting authority). Communication with the external server may be performed in a challenge-response scenario (e.g. using a nonce) and could be performed directly from the driver 2 or via the auxiliary load 7.

The process 55 may also comprise a step 57 of determining permissions, based on an outcome of the step 56. If the identifying information does not contain license data issued by a trusted license granting authority, then no permissions are associated with or otherwise granted to the auxiliary load. If the identifying information does contain license data issued by a trusted license granting authority, then permissions of the auxiliary load may be determined based on the license data and/or other elements of the identifying information.

The permission checker may, in some embodiments, be considered to be a license checker adapted to check a validity or extent of a license for the auxiliary load and determine permissions based thereon.

For example, the identifying information may contain information about desired permissions for the auxiliary load. In another example, a level of the license associated with the license data (which may be determined by cryptographical checks) may define permissions for the auxiliary load (e.g. a license of a higher level is associated with more permissions).

In yet another example, elements of the identifying information, such as a serial number or license details, may be compared to information stored in a database (of a database server). The database may detail permissions, e.g. in a look-up table, to be granted to auxiliary loads having particular serial numbers or other elements of the identifying information. For example, an auxiliary load having a serial number within a particular range may be permitted to draw a first maximum power from a driver, whereas an auxiliary load having a serial number in another range may only be permitted to draw a second, lower maximum power from the driver. The database server may, for example, be located in a distributed network such as a cloud-computing network, or may be located in the driver itself, such as in a dedicated memory.

In an example, further parameters of the driver, primary load and/or auxiliary load may be used to determine the permissions. Such further parameters may include any one or more of: a location of the driver, an identity of the driver, capabilities of the driver; capabilities of the primary load; capabilities of the auxiliary load; a number of loads connected to the driver; a number of times the identifying signal has been provided to the driver and so on. A lookup table, stored in a database of a database server, may be used to determine permissions based on these further parameters. Thus, permissions of an auxiliary load may vary based on other parameters of the driver and/or auxiliary load (such as varying on a driver-to-driver basis).

In one example, the identifying information or identifying signal contains desired permissions of the auxiliary load, which are granted if it is determined that the identifying information contains license information issued by a trusted license granting authority or if authenticated license information is of a certain level.

Generally speaking, the process 55 comprises a step 56 of validating the authenticity of identifying information for a driver and a step 57 of determining permissions for the auxiliary load based on the authenticated identifying information and optionally other parameters of the driver/auxiliary load.

Steps 53 to 57 may be performed by a permission checker (not shown) of the driver. In some embodiments, the permission checker is formed as an aspect of the driver controller 10, but in other embodiments the permission checker is a separate processor or controller.

Rather than using cryptographical means, in a cruder embodiment the step 56 may comprises comparing identifying information for the auxiliary load, such as a serial number, to records of a database (of a database server). If the identifying information is present in the records of a database, it is determined that the auxiliary load is associated with at least one permission, which may be determined as described above. This method increases a simplicity of the system, and reduces a reliance on external servers (such as trusted license granting authorities). However, such a system may disadvantageously allow for 'spoofing' of an auxiliary load, which is typically avoided using the trusted license granting method previously described.

In one preferable embodiment, the method 50 comprises a step 58 of determining whether the identifying information is associated with a permission to draw power from the driver. The step 58 may thereby identify whether the auxiliary load is permitted to draw power from the power supply 3 of the driver 2. As detailed above, a permission to draw power from the driver may be granted in response to identifying information for an identifying signal containing license data issued by a trusted license granting authority.

In response to the availability or presence of this permission, the method comprises a step 59A of permitting power to flow to the auxiliary load 7, for example, by allowing the power supply to connect to the auxiliary power output 6. Alternatively, permitting power to flow to the primary load. If no such permission is present, the method instead goes to a step 59B of restricting power flow to the auxiliary load. The step 59B may comprise entirely prohibiting power to flow to the auxiliary load (e.g. via the auxiliary power output) or simply limiting the maximum power to the auxiliary load (e.g. limit to a trickle current). Alternatively, prohibiting power to flow to the primary load (e.g. via the primary power output) or simply limiting the maximum power to the primary load (e.g. limit to a stand-by state).

By limiting the maximum power to the auxiliary load to a trickle current, operation of an unauthorized auxiliary load may be prevented (e.g. as insufficient power is provided) but disconnection of the unauthorized auxiliary load may still be detected, as a power consumption change may still be monitored. Upon detecting such disconnection, the power provided to the auxiliary load may be increased so as to allow a new auxiliary load to be connected and permit the newly connected auxiliary load to perform appropriate actions.

Control over the power supply to the auxiliary load and/or the primary load may be performed, for example, using a power limiting unit. The power limiting unit may be operable to controllably: disconnect the auxiliary power output from the power supply (e.g. using a switch or transistor) and/or stop driving the primary power output with power, connect the auxiliary power output to a ground voltage or control a resistance of a variable resistor. Other methods will be readily apparent to the skilled person.

Thus, the driver controller 10 may be adapted to limit or restrict a level of a power supply provided to the auxiliary load (at the auxiliary power output) based on at least one determined permission of the auxiliary load connected/disconnected to/from the auxiliary power output.

Thus, alternatively, the driver controller 10 may be adapted to limit or restrict a level of a power supply provided to the primary load (at the primary power output) based on at least one determined permission of the auxiliary load connected/disconnected to/from the auxiliary power output.

The driver controller 10 may thereby be adapted to authorize the auxiliary load (and/or the primary load) to draw power from the power supply 3 based on identifying information (i.e. the identifying signal) for the auxiliary load.

Of course, the restricting and/or limiting of the power supply to the auxiliary load may be performed independently of determining permissions of the auxiliary load. By way of example, the driver controller may default to initially limiting a power supply to the load unless it is determined that the auxiliary load is permitted to receive such a power supply.

Rather than only a permission to draw power from the driver, in some examples, the at least one permission of the auxiliary load comprises any one or more of: a permission to draw power from the power supply of the driver; a permission to communicate with the driver controller or to obtain certain data from it; a permission to communicate with the primary load or obtain certain data from it; a permission to control an operation of the driver; a permission to control an operation of the primary load.

Thus, the auxiliary load may be able to communicate with the primary load and/or the driver in order to control actions of the driver/primary load. The auxiliary load may require permission to do so, which can be granted following a process of determining the permissions of the auxiliary load.

It will be appreciated that the process 55 may determine that there are no permissions associated with an auxiliary load (i.e. the auxiliary load is not permitted to perform any action with respect to the driver 2). In some embodiments, it is also assumed that a newly connected auxiliary load is not associated with any permissions if no identifying signal for the auxiliary load has been provided (e.g. within a predetermined time period or in response to an explicit request 53). This will advantageously prevent unknown and potentially unauthorized devices from drawing power from the driver.

In at least one embodiment, if it is determined that the identifying information for the auxiliary load is not associated with any permissions with respect to the driver 2, the method 50 may comprise generating an alert signal. The alert signal may be provided to an external monitoring system, such as a cloud-computing system, to the primary load 5 or used to control an operation of the driver 2.

In some embodiments, the alert signal controls an operation of the primary load to indicate that an unauthorized auxiliary load, being a load associated with no permissions with respect to the driver 2, has been connected to the driver via the auxiliary power output 6. Said operation of the primary load may for example be a visual (e.g. light) or audio output.

In an example in which the primary load comprises a light source, the alert signal may cause a cyclical (i.e. periodic) blink of light output by the light source. The control of the operation of the primary load may be provided for a predetermined period of time, for example, between 1 to 7 hours, such as around 5 hours. By way of example, a light output by a light source of a primary load may be made to blink (i.e. cyclically turn on and off) for a predetermined period of time, for example between 1 to 7 hours. The periodic blink of light may occur, for example, every second, every two seconds or every five seconds during the predetermined period of time. Said blink may also be a visual light communication signal.

In embodiments, the alert signal may control an operation of an audio/visual/tactile element of the driver 3 and/or primary load. Preferably, the audio/visual/tactile element is controlled to output a particular (temporal or spatial) pattern. For example, the alert signal may cause lights of a visual element (e.g. signaling LEDs) of the driver and/or primary load to light up in a predetermined sequence with respect to time and/or in a predetermined array of output light. In another example, a particular sound may be emitted by an audio element if the alert signal indicates that an unauthorized load has been connected to the driver.

The driver 2 may be adapted to generate an audio/visual/tactile output identifying the permissions of the auxiliary load and/or an alert signal. This may be performed visually, audibly or tactilely. For example, the driver 2 may comprise a screen (not shown) which outputs a list of the determined permissions of the auxiliary load. This may increase an ease of installing the auxiliary load to the driver, and ensure that a user is installing a correct auxiliary load.

The proposed embodiments thereby advantageously instruct an installer of the auxiliary load (i.e. someone connecting the auxiliary load 7 to the driver 2) as to their usage of an incorrect or non-permissible auxiliary load 7.

There may be a step (not shown) of monitoring a number of times an identifying signal has been passed to the driver for validation, or how many times that an auxiliary load having no permissions has tried to connect to the auxiliary power output. This step may be carried out by the driver itself or by a monitoring system, such as the cloud-computing system.

The driver may be adapted to generate a second alert signal if the number of times is greater than a predetermined number of times, e.g. more than 2 or more than 10. In some embodiments, the driver may no longer check for auxiliary load connection (i.e. shut off the auxiliary power output) for a predetermined period of time, in response to the second alert signal being generated.

It has also been recognized that a potential attacker of the system, wishing to connect an unauthorized auxiliary load to the driver while bypassing a checking method (e.g. as performed in steps 53 to 59B) that would otherwise cut the power to the auxiliary load, could attempt a mains power disconnection attack. The mains power disconnection attack may comprise temporarily detaching the driver from its own mains power supply, thereby making the driver inert and unable to execute the method 50, attaching the auxiliary load, and then reconnecting the driver to its power supply. Thus, a mains power disconnection attack comprises attaching an auxiliary load to the driver when it is disconnected from a mains power (i.e. is not active).

To protect against such an attack, a checking method similar to steps 53 and onwards should be performed by the driver 2 after an interruption of its own power supply. Thus, an identity check of the auxiliary load(s) may be performed by the driver when the driver is powered on. This check could by implemented by including a trigger for it in the power-up-boot software code of the driver controller.

Figure 6:
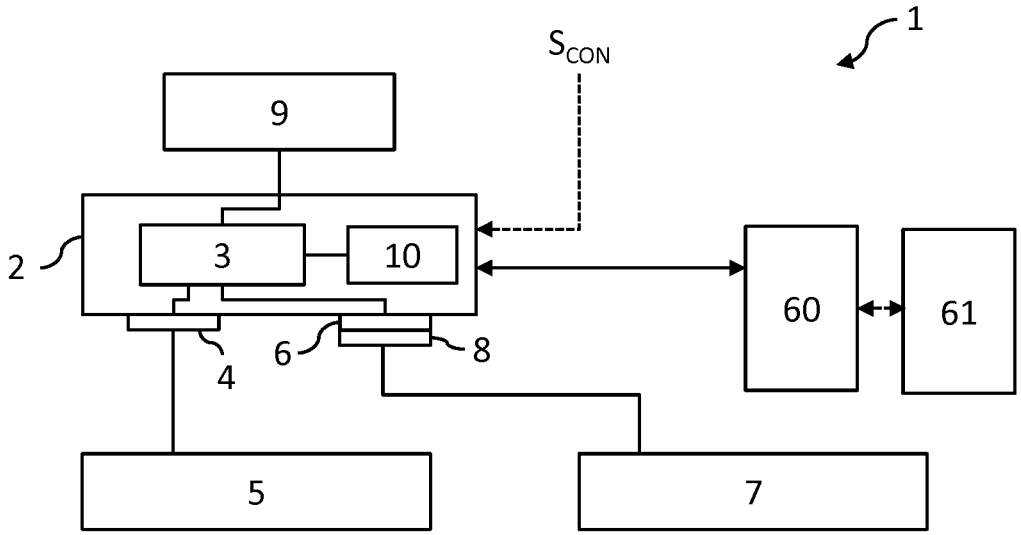
FIG. 6 illustrates a driver according to an amended embodiment of the invention.

Other variations on the method 50 will be described with further reference to FIG. 6, which illustrates a modified lighting installation 1 having a driver 2 according to another embodiment.

The driver 2 is adapted to communicate with an independent device 60 separate to the driver 2 and the auxiliary load 7. An example of a possible independent device 60 is a mobile phone or smartphone.

In an embodiment, the identifying signal, received at step 54 of method 50, may be provided by the independent device 60. Accordingly, the independent device 60 may be adapted to provide the identifying signal for the auxiliary load. In some such embodiments, the auxiliary load 7 may be unable to directly communicate with the driver 2 and/or driver controller 10. Thus, the independent device 60 may act as the auxiliary load of previously described embodiments for steps associated with identifying information.

In some embodiments, identifying information for the auxiliary load (generated by the independent device 60) may be passed to an authorization server 61 for authentication. The authorization server may generate license data for an identifying signal to be passed to the driver 2.

In embodiments, when performing the process 55 of determining permissions of the auxiliary load, the permission checker may be adapted to communicate with an authorization server 61 so as to cryptographically check license data of an identifying signal of the auxiliary load. The permission checker 10 may communicate with the authorization server 61 via the independent device 60, as illustrated in FIG. 6, or via the auxiliary load as described in previous embodiments.

To maximize system security, the permission checker, formed as an aspect of the driver controller 10, may be designed so that the independent device 60 is unable to itself create license data (of identifying information in an identifying signal) which is acceptable by the permission checker. Instead, the independent device 60 may be required to contact an authorization server 61 to generate an identifying signal containing appropriate license data. Typically, this server will be in a highly secure facility, reachable via the internet, such as a cloud-computing network or cloud computing service provider.

One implementation method for the driver 2, to force the live participation of an authorization server 61, is to generate a cryptographic nonce (being a portion of a request for an identifying signal) that has to be sent to the authorization server 61, with the nonce acting as a challenge in a challenge-response protocol. The server 61 can use the nonce to create a signed cryptographic response that is then returned to the permission checker. Thus, the nonce acts as a portion of a request for an identifying signal issued in step 53 and the signed cryptographic response may act as the identifying signal of the auxiliary load provided in step 54. By using the nonce, several types of capture-and-replay attacks can be detected and prevented, improving system security. By using cryptographic signing, several types of attacks that could modify the identifying signal (e.g. permissions forming part of the identifying signal) while in transit, may be detected and prevented to thereby improve system security.

The permission checker may subsequently validate the integrity and authenticity of the response by using public key information for the authorization server that has been stored within the driver, e.g. at the manufacturing time of the driver.

The response (e.g. to the request that may include a nonce) may also include a list of permissions for the auxiliary load created by the server 61, based on the server establishing the identity of the auxiliary load, using an authentication protocol secured by cryptographic means. For example, when passing the request with the nonce to the server 61, the independent device may also obtain and pass on some identifying information for the auxiliary load (such as a serial number), which is used to determine permissions by the server 61.

For example, the independent device 60 may comprise a barcode scanner adapted to scan a barcode for the auxiliary load (e.g. located on the auxiliary load itself) and used to create, potentially with the use of the nonce and the help of the server 61 in the manner described above, an identifying signal including permissions that will be accepted by the permission checker of driver 2, with permissions chosen in part based on the scanned barcode. Thus, in embodiments, a scanned barcode may be passed to the server 61 for authentication (optionally based further on a nonce provided by the permission checker of the driver 2).

In another embodiment, the independent device may comprise a near-field communication device (which communicates with the auxiliary load) or a radio-frequency identification, RFID, device adapted to generate an identifying signal of the auxiliary load, e.g. by communicating with the auxiliary load or scanning a RFID tag of the auxiliary load.

In yet other embodiments, a user of the independent device 60 may input, via an input device such as a keyboard or touch screen, identifying information, a code or a password which represents the auxiliary load connected to the driver 2. This input identifying information is transmitted by the independent device to the device controller 10 (optionally the preparation of the identifying information is performed with the help of an authorization server 61).

The independent device 60 may be able to communicate using any known communication protocol, for example, wireless communication protocols such as Bluetooth, Wi-Fi or wired communication protocols such as UART protocols. Other suitable communication protocols will be readily apparent to the person skilled in the art.

In at least one conceivable embodiment, the independent device 60 may perform the determining the permissions of the auxiliary load 7, rather than being performed by the driver 2. For example, the independent device may compare an identifying signal of the auxiliary load to records of a database, e.g. stored in the independent device or on an external server, to determine permissions of the auxiliary load. These permissions may then be passed to the driver 2 for suitable execution by the driver controller 10.

In an embodiment, an alert signal generated by the driver (controller) is passed to the independent device. The alert signal may, for example, cause an alert to be displayed by the independent device (such as displaying text on a screen of the independent device). The alert may be generated by a smart phone running a particular application or program.

Figure 7:
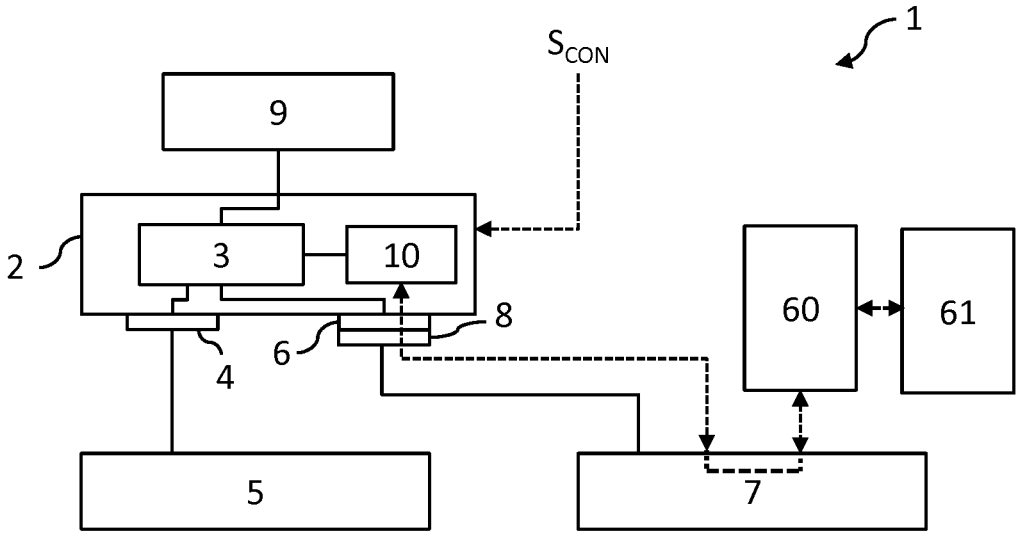
FIG. 7 illustrates a driver according to a yet further amended embodiment of the invention.

FIG. 7 illustrates another variation to previously described apparatus and methods. In particular, FIG. 7 illustrates an arrangement similar to that of FIG. 6, but in this case the independent device 60 and the driver 2 (e.g. with a permission checker) have no means of direct communication. Instead, the auxiliary load 7 provides a communications channel between the independent device 60, and optionally the authentication server 61, and the driver. This unusual arrangement is advantageous because it prevents the need for costly extra communications hardware in the driver (e.g. to communicate with the independent device 60).

In one possible arrangement, as shown in FIG. 7, the auxiliary load creates a communications channel from the independent device to the driver using electrical wiring that runs via the auxiliary power output 6. This has additional advantages in system security, preventing some types of man-in-the-middle or impersonation attacks, and may also save material costs. Thus, the auxiliary load 7 may act a routing device for communications between the driver 2 and the independent device 60 (and optionally onwards to the authorization device). In this way, the driver may be adapted to receive messages, including the identifying signal, over a wired communication channel between the auxiliary load and the driver.

The auxiliary load may communicate with the independent device using a wireless protocol. Such an embodiment is particularly advantageous when the auxiliary load is a communications module providing communication capabilities to the driver and/or primary load in order to reduce additional or unnecessary hardware.

It should be noted that an untrusted, hostile auxiliary load acting as a communication channel will be able to attempt attacks on system security by modifying some messages that flow through it, e.g. attempting to obtain permissions that have not been granted, or by capturing messages flowing through it for future use in re-play attacks. To prevent the above types of attacks by a hostile auxiliary load, well known cryptographic techniques can be used to protect the communication channel, to make it secure end-to-end even though the channel flows via a potentially untrusted intermediary. Examples of these are the use of a nonce and the signing of messages as described earlier.

In general, with respect to all descriptions of cryptographic measures above, several alternatives are also possible. These alternatives may sometimes save on hardware costs, especially costs in the driver, thereby reducing a cost and size of the hardware. In one alternative (slightly less secure than using a nonce), a message sequence counter in the identifying information can be used, to prevent some types of replay attacks. In another alternative (slightly less secure than using signing with public key cryptography) message signing using symmetric cryptography with a 'shared secret' key, a number only known to the permission checker (i.e. the driver) and to the authentication server, can be used. Preferably, in this case the driver needs to be constructed so that it is difficult for an attacker who is in possession of the driver hardware to extract the 'shared secret' key from the driver. If this extraction is made very difficult, a further optimization, to save costs and improve efficiency, could be to use the same shared secret key in several physical copies of the driver (i.e. different drivers have a same shared secret key).

For the sake of security and improved reliability in providing an identifying signal, a wired communication protocol can be used, where the identifying signal is provided to the driver controller via the wires running through the connector for the auxiliary power output. In some embodiments, the auxiliary load may route information from the independent device and/or the authentication server 61.

This would also reduce an amount of wiring and/or components (e.g. Bluetooth or NFC receivers) required to pass the identifying signal to the driver controller.

In one such embodiment, the driver may comprise a pair of wires which run to the auxiliary output, which use a DALI bus protocol that combines power delivery and bidirectional communication facilities over just this pair of wires. In another embodiment, there may be four wires running through the connector for the auxiliary power output, two wires being power and ground wires, and the other two wires being used for bidirectional communication, using an electrical protocol such as UART, USB, or $I^2C$.

Of course, in other embodiments the auxiliary load communicates with the driver using a wireless protocol.

Methods described with reference to FIGS. 6 and 7 (i.e. use of a nonce and/or authorization server) may be adapted for use with an auxiliary load alone, i.e. without the need for an independent device. By way of example, an auxiliary load 7 may be able to directly communicate with an authorization server 61 and thereby act in the stead of the independent device 60 of FIGS. 6 and 7. Thus, the auxiliary load may act as a routing device for communications between the driver 2 and the authorization server 61. Alternatively, the driver and the authorization server may directly communicate with one another.

In some variants of the invention, the current sensing device 35 may be designed to provide information about how much power is being consumed, rather than just a binary signal as previously described.

This detailed information may comprise, for example, information that more than a predetermined amount of power (e.g. 10 W) is being consumed by the auxiliary load or how much power is being consumed by the auxiliary load. Particular actions may be triggered on the basis of such detailed information, and this allows for an increased amount of customizability over the actions performed by the driver 2.

By way of example, an unexpectedly high power consumption, such as a consumption which is greater than expected for a connected auxiliary load (e.g. calculated based on its identifying information), likely indicates a short circuit inside the auxiliary load that may pose a danger to the driver and/or load. The driver may cause the controller to interrupt power to the auxiliary load (e.g. disconnect the auxiliary output from the power supply) to thereby avoid said danger.

In another envisaged variant, the driver may increase the security of the system by monitoring the power being consumed by the auxiliary load. This applies in particular to auxiliary loads that have a live network connection, and that can therefore potentially be infected with malware. The driver can compare the power being consumed by the auxiliary load to 'power fingerprint' information that describes how the auxiliary load should draw power under normal operation (which could be identified based on identifying information for the auxiliary load). If there are large discrepancies, it is likely that the auxiliary load has been infected with malware. The driver can respond by interrupting the power to the auxiliary load, thereby increasing system security by limiting the time window available for the malware to operate. This type of protection is specifically significant to protect against 'botnet' malware that scans the network to re-infect other equipment.

In some embodiments, the driver comprises two or more auxiliary power outputs or interfaces for connecting to a respective two or more auxiliary loads. The driver controller may be adapted to detect respective connections or disconnections of auxiliary loads to each of the auxiliary power outputs and perform a respective action in response thereto.

Embodiments generate relate to an action (to be performed by the driver) which comprises determining one or more permissions of the auxiliary load, such as a permission to draw power. However, various other actions to be performed by the driver are envisaged. For example, an action may comprise starting a billing transaction (e.g. a timer) when an auxiliary load is connected and ending a billing transaction when an auxiliary load is disconnected. This would allow an operator of the driver to bill an operator of the auxiliary load for a time over which the auxiliary load is connected to the driver (e.g. to pay for a power drawn by the auxiliary load or for services performed and so on). Other possible actions have been previously indicated.

Whilst embodiments have generally been described in relation to drivers for lighting installations, the skilled person will appreciate that the concept may be applied to other drivers having a primary and auxiliary output for a primary and auxiliary load respectively. This may, for example, be in the context of a sound installation; a visual output system; a computing system and so on.

The auxiliary load may be adapted to provide communication, sensing or monitoring capabilities to the driver and/or primary load (or other loads connected to the driver). For example, the auxiliary load may be adapted to communicate with a network bridge in order to provide control information to the primary load (e.g. to control a brightness of a light source of the primary load) or to provide the network bridge with sensory data (e.g. a temperature in the vicinity of the driver/primary load).

There is proposed a control method of a driver having a primary power output adapted to electrically connect to a primary load of the driver; an auxiliary power output adapted to electrically connect to an auxiliary load of the driver; and a power supply for providing power to the primary power output and the auxiliary power output, the method comprising: determining whether there is a change in a power consumption at the auxiliary power output caused by an auxiliary load connecting to or disconnecting from the auxiliary power output; and in response to determining that said change in power consumption has occurred, performing at least one action in respect of the auxiliary load and/or the primary load.

The method may comprise controllably cutting off or limiting, using a power limiting unit, the power provided to an auxiliary load connected to the auxiliary power output and/or a primary load connected to the primary power output.

The at least one action of the method may comprise determining an availability of an identifying signal for the auxiliary load. Preferably, the identifying signal comprises digitally readable identifying information for the auxiliary load, and the method may comprise, in response to determining that the identifying signal is available, processing the digitally readable identifying information for the auxiliary load, using a permission checker, to determine at least one permission of the auxiliary load.

The method may be adapted to use cryptographic means to verify whether the digitally readable identifying information comprises license data which has been generated by a trusted license granting authority so as to determine the at least one permission of the auxiliary load.

The at least one permission of the auxiliary load may comprise a permission to draw power from the driver, and the method may be adapted to comprise either cutting off or limiting the power provided to an auxiliary load connected to the auxiliary power output if the auxiliary load is not associated with a permission to draw power from the driver. Moreover, in examples, the method may be adapted to comprise either cutting off or limiting the power provided to an primary load connected to the primary power output if the auxiliary load is not associated with a permission to draw power from the driver.

The method may comprise receiving the identifying signal via a communication channel between the driver and the auxiliary load.

The at least one action performed according to the method may comprise any one or more of: limiting a maximum power drawn by a connected auxiliary load; determining an identity of a connected or disconnected auxiliary load; determining a classification type of a connected or disconnected auxiliary load; generating an output signal indicating whether an auxiliary load has been connected to or disconnected from the auxiliary power output; comparing a power drain of the primary load and a power drain of the auxiliary load; beginning or ending a timer; beginning or ending a monetary or billing transaction; performing an authorization check for the auxiliary load; performing an authorization check for the auxiliary load and sending an alert signal if the check does not detect that the auxiliary load is authorized; and performing an authorization check for the auxiliary load and sending an alert signal if the check does not detect that the auxiliary load is authorized, wherein the alert signal controls an operation of the primary load so to indicate an alert.

Any above-described method may be carried out using a driver controller, for example.

As discussed above, embodiments make use of a driver controller. The controller can be implemented in numerous ways, with software and/or hardware, to perform the various functions required. A processor is one example of a driver controller which employs one or more microprocessors that may be programmed using software (e.g., microcode) to perform the required functions. A driver controller may however be implemented with or without employing a processor, and also may be implemented as a combination of dedicated hardware to perform some functions and a processor (e.g., one or more programmed microprocessors and associated circuitry) to perform other functions.

Examples of driver controller components that may be employed in various embodiments of the present disclosure include, but are not limited to, conventional microprocessors, application specific integrated circuits (ASICs), and field-programmable gate arrays (FPGAs).

In various implementations, a processor or driver controller may be associated with one or more storage media such as volatile and non-volatile computer memory such as RAM, PROM, EPROM, and EEPROM. The storage media may be encoded with one or more programs that, when executed on one or more processors and/or controllers, perform the required functions. Various storage media may be fixed within a processor or driver controller or may be transportable, such that the one or more programs stored thereon can be loaded into a processor or driver controller.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A lighting driver comprising:

a primary power output adapted to electrically connect to a primary load of the lighting driver, wherein the primary load is a light source comprising a LED;

an auxiliary power output adapted to electrically connect to an auxiliary load of the lighting driver;

a power supply for providing power to the primary power output and the auxiliary power output; and a driver controller adapted to:

determine whether there is an instantaneous change in a power consumption at the auxiliary power output characterized and caused by an auxiliary load connecting to or disconnecting from the auxiliary power output; and in response to determining that said change in power consumption has occurred, perform at least one action in respect of the auxiliary load;

wherein the at least one action performed by the driver controller comprises performing an authorization check for the auxiliary load and sending an alert signal if the check does not detect that the auxiliary load is authorized, wherein the alert signal controls an operation of the primary load so to indicate an alert.

2. The lighting driver of claim 1, wherein a maximum power provided to the primary output is greater than a maximum power provided to the auxiliary output.

3. The lighting driver of claim 1, further comprising a power limiting unit adapted to controllably cut off or limit the power provided to an auxiliary load connected to the auxiliary power output.

4. The lighting driver of claim 1, wherein the at least one action performed by the driver controller comprises determining an availability of an identifying signal for the auxiliary load.

5. The lighting driver of claim 4, wherein the identifying signal comprises digitally readable identifying information for the auxiliary load, and the driver further comprises a permission checker adapted to, in response to determining that the identifying signal is available, process the digitally readable identifying information for the auxiliary load to determine at least one permission of the auxiliary load.

6. The lighting driver of claim 5, wherein the permission checker is adapted to use cryptographic means to verify whether the digitally readable identifying information comprises license data which has been generated by a trusted license granting authority so as to determine at least one permission of the auxiliary load.

7. The lighting driver of claim 5, wherein the at least one permission of the auxiliary load comprises a permission to draw power from the lighting driver, and the driver controller is adapted to either cutting off or limiting the power provided to an auxiliary load connected to the auxiliary power output if the auxiliary load is not associated with a permission to draw power from the driver.

8. The lighting driver of claim 4, wherein the driver is adapted to receive the identifying signal via a communication channel between the lighting driver and the auxiliary load.

9. The lighting driver of claim 1, wherein the at least one action performed by the driver controller further comprises any one or more of:

limiting a maximum power drawn by a connected auxiliary load;

determining an identity of a connected or disconnected auxiliary load;

determining a classification type of a connected or disconnected auxiliary load;

generating an output signal indicating whether an auxiliary load has been connected to or disconnected from the auxiliary power output;

comparing a power drain of the primary load and a power drain of the auxiliary load;

beginning or ending a timer;

beginning or ending a monetary or billing transaction;

performing an authorization check for the auxiliary load;

performing an authorization check for the auxiliary load and sending an alert signal if the check does not detect that the auxiliary load is authorized.

10. A lighting installation comprising a lighting driver according to claim 1, wherein the primary power output is adapted to connect to a light source of the lighting installation; and the auxiliary power output is adapted to connect to an auxiliary load which provides sensing, control, communication or monitoring capabilities for the lighting installation.

11. A control method of a lighting driver having a primary power output adapted to electrically connect to a primary load of the lighting driver, wherein the primary load is a light source comprising a LED; an auxiliary power output adapted to electrically connect to an auxiliary load of the lighting driver; and a power supply for providing power to the primary power output and the auxiliary power output, the method comprising:

determining whether there is an instantaneous change in a power consumption at the auxiliary power output characterized and caused by an auxiliary load connecting to or disconnecting from the auxiliary power output; and in response to determining that said change in power consumption has occurred, performing at least one action in respect of the auxiliary load;

wherein the at least one action performed by the driver controller comprises performing an authorization check for the auxiliary load and sending an alert signal if the check does not detect that the auxiliary load is authorized, wherein the alert signal controls an operation of the primary load so to indicate an alert.

12. The control method of claim 11, wherein the at least one action further comprises determining an availability of an identifying signal for the auxiliary load and wherein the identifying signal comprises digitally readable identifying information for the auxiliary load, and the method further, in response to determining that the identifying signal is available, processing the digitally readable identifying information for the auxiliary load using a permission checker to determine at least one permission of the auxiliary load.

13. The control method of claim 12, further comprising controllably limiting the power provided to an auxiliary load connected to the auxiliary power output of the lighting driver and/or to a primary load connected to the primary power output based on the determined at least one permission of the auxiliary load.

14. A computer program comprising computer program code means which is adapted, when said computer program is run on a computer, to perform the method of claim 11.

* * * * *